US006394340B1

(12) United States Patent
Anchor et al.

(10) Patent No.: US 6,394,340 B1
(45) Date of Patent: May 28, 2002

(54) PACKAGE WITH EASY-OPENING COVER PORTION

(75) Inventors: David Anchor, Union; Sheila Moss, Barrington; Matt Aho, Chicago; Craig Boyd, Arlington Heights; Chris Moss, Barrington, all of IL (US)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 09/680,591

(22) Filed: Oct. 6, 2000

(51) Int. Cl.[7] ..... B65D 17/00

(52) U.S. Cl. ..... 229/232; 229/207; 229/226; 229/217

(58) Field of Search ..... 229/232, 214, 229/226, 217, 228, 229, 207, 209

(56) References Cited

U.S. PATENT DOCUMENTS

| | | | | | |
|---|---|---|---|---|---|
| 2,218,670 | A | | 10/1940 | Bennett | |
| 2,270,617 | A | | 1/1942 | Bennett | |
| 2,288,914 | A | | 7/1942 | Monroe | |
| 2,360,439 | A | | 10/1944 | Monroe | |
| 2,828,060 | A | * | 3/1958 | Brown | 229/232 |
| 2,963,209 | A | | 12/1960 | Hovland | |
| 2,973,086 | A | | 2/1961 | Thompson | |
| 3,113,713 | A | * | 12/1963 | Green | 229/209 |
| 3,167,238 | A | * | 1/1965 | Smith | 229/207 |
| 3,272,425 | A | | 9/1966 | Bendersky et al. | |
| 3,286,909 | A | * | 11/1966 | Scharre | 229/207 |
| 3,399,820 | A | * | 9/1968 | Foster et al. | 229/207 |
| 3,438,565 | A | | 4/1969 | Lugt et al. | |
| 3,654,842 | A | | 4/1972 | Schwenk | |
| 3,814,301 | A | | 6/1974 | Niepmann | |
| 3,971,506 | A | | 7/1976 | Roenna | |
| 4,043,503 | A | * | 8/1977 | Meyers et al. | 229/207 |
| 4,449,633 | A | * | 5/1984 | Johnson et al. | 229/123.2 X |
| 4,482,056 | A | | 11/1984 | Dutcher | |
| 4,687,104 | A | * | 8/1987 | Ielmini | 229/207 |
| 4,738,365 | A | * | 4/1988 | Prater | 229/207 X |
| 4,865,203 | A | | 9/1989 | Ueda | |
| 4,886,170 | A | * | 12/1989 | Willey et al. | 229/207 |
| 5,085,323 | A | * | 2/1992 | Kuchenbecker et al. | 229/207 |
| 5,588,587 | A | * | 12/1996 | Stier et al. | 229/232 |

* cited by examiner

*Primary Examiner*—Lee Young
*Assistant Examiner*—Tri M. Mai
(74) *Attorney, Agent, or Firm*—Welsh & Katz, Ltd.

(57) ABSTRACT

An easy-opening, liquid-tight package has an interior space for storage. The package includes a front wall, a rear wall opposing the front wall, a pair of opposing side walls, a bottom wall and a top wall opposing the bottom wall. A seal wall is contiguous with the top wall and extends from a juncture of the top wall and the seal wall. The seal wall has an edge that is opposite the juncture. The seal wall is sealed to the front wall at an exterior surface of the front wall. At least one line of weakness is formed in the top wall, extending from the seal wall at the edge into the top wall. The line of weakness defines a cover portion of the top wall. The cover portion is formed from a portion of the seal wall and a portion of the top wall. When the top wall and seal wall are separated along the line of weakness, the cover portion is separable from the package to define an open area for accessing the interior storage space of the package. A blank for the package is also disclosed.

23 Claims, 3 Drawing Sheets

PACKAGE WITH EASY-OPENING COVER PORTION

FIELD OF THE INVENTION

The present invention relates to a package having an easy-open feature for providing a wide access area into the package. More specifically, the present invention relates to an easily opened, wide access area package formed from standard gable top and brick-type packages.

BACKGROUND OF THE INVENTION

Gable top and brick-type packages have become widely accepted by consumers, packagers and the like, for packaging liquid foods, such as, milk and juice. To a much lesser extent, these packages are in use for packaging particulate-containing liquid foods and solid foods. However, due to the nature and arrangement of these packages, vis-a-vis the container opening or spout, their use has been limited with respect to solid foods. This is particularly true for packages that are configured for use as a serving plate, such as a bowl.

Numerous types of packaging have been developed for use as serving plates, such as bowls. One type of package is formed as a styrofoam or like bowl into which a solid food product (e.g., dry cereal) is filled. The bowl is then sealed across its top rim with, for example, a polymeric film-like liner material by well-known methods. The seal is then pealed away and milk can be added directly to the cereal which is then eaten from the serving bowl. Although this is an effective method for packaging and use, it is an inefficient use of space in distribution and shipping as well as for retailing shelf space considerations. Moreover, often, these materials cannot be used for directly heating the packaged goods, such as soups, that could otherwise be heated in a microwave oven.

Another type of package includes a rectangular cardboard box into which dry food, such as a cereal, may be stored within a high density polyethylene (HDPE), wax or like bag. This type of arrangement cannot be used for serving in that milk cannot be directly poured into the cereal. Rather, the cereal must be removed from the package and bag and placed into a conventional serving bowl. Again, these materials cannot be used for directly heating the packaged goods.

Known gable top or brick-type packages are also not suitable for this purpose. Many gable top packages now include a plastic spout or like pouring fitment. Alternately, as was known prior to these fitments (and in less costly packaging), these packages were opened by separating or opening the gable panels of the package. The gable panels are formed on a relatively small area or surface (portion) of the carton. Thus, typically, these cartons are deep and narrow which does not lend itself well for use as a serving bowl. Likewise, brick-type packages often include a closure or other opening means on a small surface of the package. Again, this does not lend itself well for use as a serving-type package.

Accordingly, there is a need for a package that can be used as a serving type of package for solid and particulate-containing foods. Desirably, such a package permits the addition of a liquid into the solid foods for serving directly therefrom. Most desirably, such a package has an enlarged opening area relative to the depth of the package. Most desirably, such a package is liquid impermeable and can be placed into a microwave oven in order to heat the contents therein.

SUMMARY OF THE INVENTION

An easy-opening liquid-tight package defines an interior storage space. The package includes a front wall, a rear wall opposing the front wall, a pair of opposing side walls, a bottom wall and a top wall opposing the bottom wall. A seal wall is contiguous with the top wall and extends from a juncture of the top wall and the seal wall. The seal wall has an edge that is opposite the juncture. The seal wall is sealed to the front wall at an exterior surface of the front wall.

At least one, and preferably two lines of weakness are formed in the top wall. The lines of weakness can be formed as perforations that extend from the seal wall at the edge into the top wall, to define a cover portion. The cover portion is formed from a portion of the seal wall and a portion of the top wall. When the top wall and seal wall are separated along the line of weakness, the cover portion is separable, at least in part, from the package to define an open area for accessing the interior storage space of the package.

A package in accordance with the present invention permits the addition of a liquid into the solid foods for serving directly therefrom. Such a package has an enlarged opening area relative to the depth of the package. Preferably, such a package is formed from liquid impermeable materials. The package can be formed from materials that permit microwave heating the package with the contents therein.

In one embodiment, the package is formed from a laminate material having a paperboard core having a thickness. The material is liquid-tight, having an inner coating layer and an outer coating layer. The perforations are formed into the laminate material. The perforations can penetrate the outer coating layer. Alternately, the perforations can penetrate the outer layer and at least a portion of, if not the entire the thickness of the paperboard core. In this manner, separation occurs, at least in part, within the paperboard core. This is carried out by forming the perforations through none of, a portion less than the entire thickness, or the entire thickness of the paperboard core.

The cover can hingedly attach to the package by discontinuation (e.g., separation) of the line of perforation. Alternately, the perforation lines connect to one another for removal of the entirety of the cover from the package.

The perforation lines can be substantially linear and parallel to one another. Alternately, they can diverge from the front of the package rearward. In such an arrangement, the cover portion can extend essentially the entire width of the package.

In either the hinged arrangement or the complete removal arrangement, the perforation lines can extend in an arcuate manner from the edge of the seal wall into the top wall toward the rear wall. In this manner, the opening can be formed resembling the rim of a bowl.

The ratio of the surface area of the cover to the overall surface area of the package can be greater than 0.5 to provide for a large access area into the package.

The package can include a tab panel extending from and contiguous with the seal wall edge to facilitate opening the package. The tab has a length that is less that the length of the seal wall. The tab is affixed to the front wall of the package at a lesser strength than the walls are sealed to one another to facilitate separating the tab from the front wall.

A perforation line can also be formed in the front wall, beneath the location at which the seal wall is sealed to the front wall. This influences tearing of the material within the core at the front wall, to facilitate opening the package.

The package can also include a dispensing opening panel disposed below the cover. The dispensing opening panel includes an opening therein for dispensing the contents from the package.

A blank for the liquid-tight package is formed from a laminated material having a paperboard core having a thickness, a coating layer on a first side of the paperboard and a coating layer on a second side of the paperboard core. The blank includes a front wall panel, a bottom wall panel contiguous with the front wall panel and separated therefrom by a first crease line, a rear wall panel contiguous with the bottom wall panel and separated therefrom by a second crease line, a top wall panel contiguous with the rear wall panel and separated therefrom by a third crease line, a seal wall panel contiguous with the top wall panel and separated therefrom by a fourth crease line and a pair of side wall panel sets.

Each of the side wall panel sets extends from and is contiguous with opposing sides of the front, bottom, rear, top and seal walls. Each of the pair of side wall panel sets is separated from their respective front, bottom, rear, top and seal walls by fifth and sixth crease lines, respectively.

At least one line of weakness is formed in the seal wall panel and the top wall panel. Preferably, two lines of weakness are formed in the blank as lines of perforations. The lines of perforations extend inwardly from an edge of the seal wall panel, across the fourth crease.

The lines of perforations can be formed substantially linear and parallel to one another. Alternately, the lines of perforations can connect. Alternately, still the lines of perforations can be formed having an arcuate path to, for example, resemble the outline of the rim of a bowl.

The lines of perforations can extend substantially to the third crease, in which case the third crease serves as a hinge.

The lines of perforations can be formed into the laminate material penetrating one of the coating layers only, one of the coating layers and at least a portion of the thickness of the paperboard core, or one of the coating layers and the entire thickness of the paperboard core, without penetrating the other of the coating layers. The lines can be formed by mechanical contact, such as by a blade or the like. Alternately, the lines of perforation can be "cut" by a laser. The lines can be formed as a series of discrete cuts into the material, or as one or more continuous lines.

These and other features and advantages of the present invention will be apparent from the following detailed description, the accompanying drawings, and the appended claims.

DETAILED DESCRIPTION OF THE PREFERRED EMBODIMENTS

Figure 1:
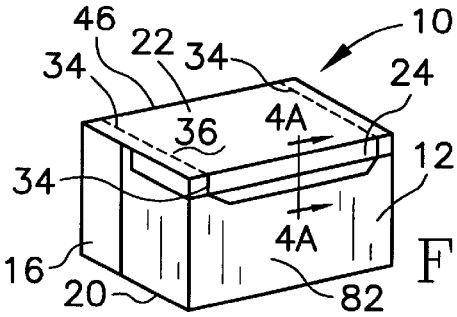
FIG. 1 is a front perspective view of one embodiment of a package with an easy-opening cover portion in accordance with the principles of the present invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Figure 2:
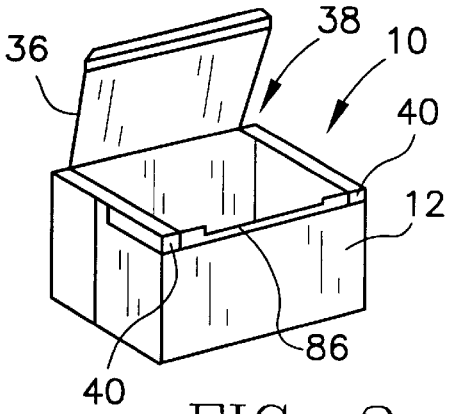
FIG. 2 is a view of the package of FIG. 1 with the cover portion opened and hinged rearwardly for access into the storage region of the package.
Figure 1A:
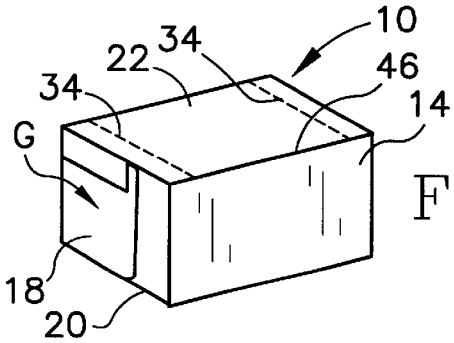
FIG. 1A is a rear perspective view of the carton of FIG. 1.

Referring now to the figures and in particular to FIGS. 1 and 2, there is shown one embodiment of an easy-open package 10, configured as a bowl, embodying the principles of the present invention. The bowl-type package 10 is intended for storing a product, such as cold cereal, and is further intended for use as a bowl, by opening the package 10, and adding, i.e., pouring milk into the package 10.

The package permits the addition of a liquid into the solid foods for serving directly therefrom. Such a package has an enlarged opening area relative to the depth of the package. Preferably, such a package is formed from liquid impermeable materials. The package can be formed from materials that permit microwave heating the package with the contents therein, for, for example, soup.

The package 10 illustrated in FIGS. 1 and 2 includes front and rear walls, 12, 14, side walls, 16, 18, a bottom wall 20 and a top wall 22. The walls 12–22 are formed from panels as a carton blank. A seal wall 24 (which will be described in more detail below) is formed extending from the top wall 22 for sealing to the front wall 12 of the package 10.

Figure 4:
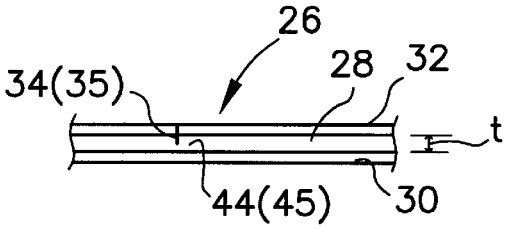
FIG. 4 is a cross-sectional view of one exemplary laminate material for forming the package taken along line 4—4 of FIG. 3.

The package 10 can be formed from various types of materials. However, in a current embodiment, as seen in FIG. 4, the package 10 is formed from a coated paperboard material 26 having a substrate or core 28 that has inner and outer sealing layers 30, 32, such as low density polyethylene (LDPE) and is formed in a laminate structure. The paperboard material 26, with each wall 12–24 folded and sealed to adjacent respective walls, forms a liquid-tight package 10. Further, an inner barrier layer (not shown) can be formed as part of the laminate, disposed adjacent the inner layer 30 of the package 10. One exemplary structure is disclosed in L öfgren et al., U.S. Pat. No. 5,133,999, commonly assigned with the present application and incorporated herein by reference. Those skilled in the art will recognize that other materials and configurations can be used for the present package to achieve liquid-impermeable characteristics, as well as the ability to heat the package within, for example, a microwave oven. All such materials and configurations are within the scope and spirit of the present invention.

Advantageously, as will be recognized from a study of the figures, the side walls 16, 18 have a "multiple panel"

thickness. That is, these walls 16, 18 are formed from a plurality of panels (as is discussed below), and thus provide an increased thickness or number of layers for thermal insulation. This enhances the ability to "handle" the package 10 when it is used, for example, as a soup bowl containing hot soup.

The package 10 is formed having at least one line of weakness 34 formed in the material 26, for opening the package 10. In the embodiment illustrated in FIGS. 1 and 2, two lines of weakness 34 are formed as perforations along the package top wall 22. These perforations 34 define a cover 36, which in turn defines an opening area, indicate at 38, for the package 10. That is, the perforations 34 permit opening or separating the package material 26 therealong to form the cover or lid 36 for the package 10.

As illustrated in FIGS. 1 and 4, the perforations 34 extend along the seal wall 24 to permit readily separating that portion of the seal wall 24 that extends between the perforations and is contiguous with the cover portion 36, from those portions of the top wall that remain sealed to the front wall, as indicated at 40.

Figure 4A:
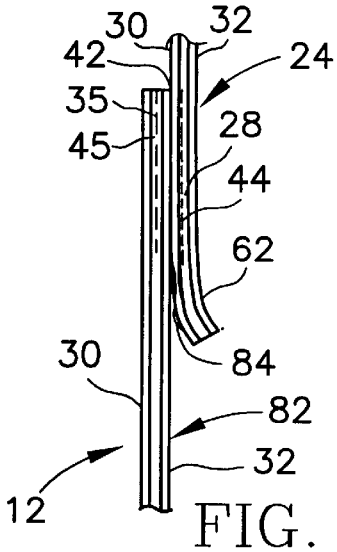
FIG. 4A is cross-sectional view of the material taken along line 4A—4A of FIG. 1, illustrating the tab portion as it is being urged from the front wall, and the separation of the material within the core.

To facilitate separating the seal wall 24 from the front wall 12, the perforations 34 can be formed through the outer sealing layer 32 only, through the outer sealing layer 32 and partially into the paperboard core 28, or through the outer sealing layer 32 and entirely through the core 28, without penetrating the inner sealing layer 30. Perforations 35 can also be formed in the front wall 12 structure in the same manner. To this end, as seen in FIG. 4A, when the seal wall 24 is urged outwardly to open package 10, the front wall 12 structure can separate within the core 28, rather than at the interface, as indicated at 42, of the front wall 12 and the seal wall 24. This facilitates readily opening the package 10 by tearing within the core as indicated at 44 relative to the seal wall 24 and/or, as indicated 45 relative to the front wall 12, rather than separating the walls 12, 24 at the interface 42.

It has been observed that because of the strength of the inner sealing layer 30 to outer sealing layer 32 bond (when these layers are bonded to one another during package erection as by heat sealing), it is easier to tear the core 28. This makes for an easier opening package 10, in contrast to attempting to separate the walls 12, 24 from one another where they are sealed or bonded together.

Figure 6:
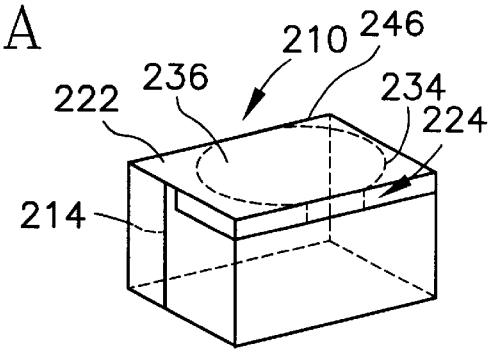
FIG. 6 is still another alternate embodiment of the easy-open package, this embodiment also being formed from a conventional gable top carton.
Figure 5:
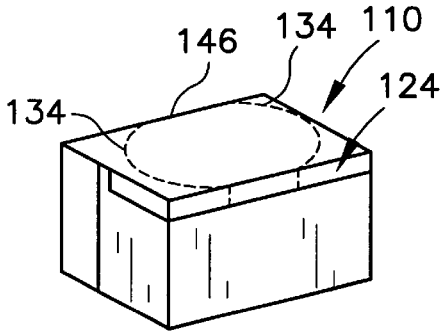
FIG. 5 is an alternate embodiment of the easy-open package having an oval cover portion, this embodiment being formed from a conventional gable top carton.

As is seen in FIGS. 1 and 2 the perforations 34 can be formed in straight lines extending along the top wall 22 and seal wall 24 of the package 10, from the front to the rear of the package 10. The crease 46 at the top wall/rear wall juncture provides a hinge for the cover portion 36. Alternately, as shown in FIG. 5, the perforations 134 can be formed in an arcuate manner to resemble the outline of a bowl when the package 110 is opened. Alternately again, as illustrated on the package 210 in FIG. 6, the line of weakness or perforations 234 can be formed as a continuous line so that the cover 236 can be fully removed from the package 210 rather than hinged rearwardly. Alternately, though not shown, the perforations 236 can extend over the top wall/rear wall 222/214 juncture, as indicated at 246, a short distance down the rear wall 214 to provide an even greater open area.

The lines of weakness, e.g., perforations 34, 35, 134, 234, 334, can be formed in a variety of ways and can have a variety of configurations. The perforations can be mechanically formed, such as by deep embossing or cutting into the material 26. Alternately, the perforations can be cut by, for example, a laser cutting tool. Such tools can, as will be recognized by those skilled in the art, be controlled, vis-à-vis energy emitted, to precisely control the depth of the cut. It is contemplated that the cut depth be determined and provided to facilitate readily opening the package along the perforation lines.

To this end, the cut depth can be through the outer sealing layer 32 only, through the outer sealing layer 32 and into a portion of the thickness t of the core 28. Alternately, the cut depth of the perforations can be though the entire thickness t of the core 28. Still alternately, the cut depth can be through the core 28 and can contact, but not penetrate the inner sealing layer 30, so as to stress that layer to influence tearing at the stressed location. All such perforation types, depths and methods are within the scope and spirit of the present invention.

In addition, the lines of weakness, e.g., perforations 34, 35, 134, 234, 334, can be formed as a series of discrete cut sections (e.g., having a dashed line appearance). Alternately, the perforations can be formed as a single continuous or contiguous formation (as by continuous laser cutting or contact by a wheel or knife having a smooth cutting edge). All such perforation types and methods are within the scope and spirit of the present invention.

The type, depth and method of forming the lines of weakness, e.g., the perforations 34, 35, 134, 234, 334, must take into consideration the rigors of packaging and distribution of the filled package 10, while achieving the goal of providing a package 10 that opens at the desired location, e.g., along the perforations 34, 35, 134, 234, 334.

Figure 3:
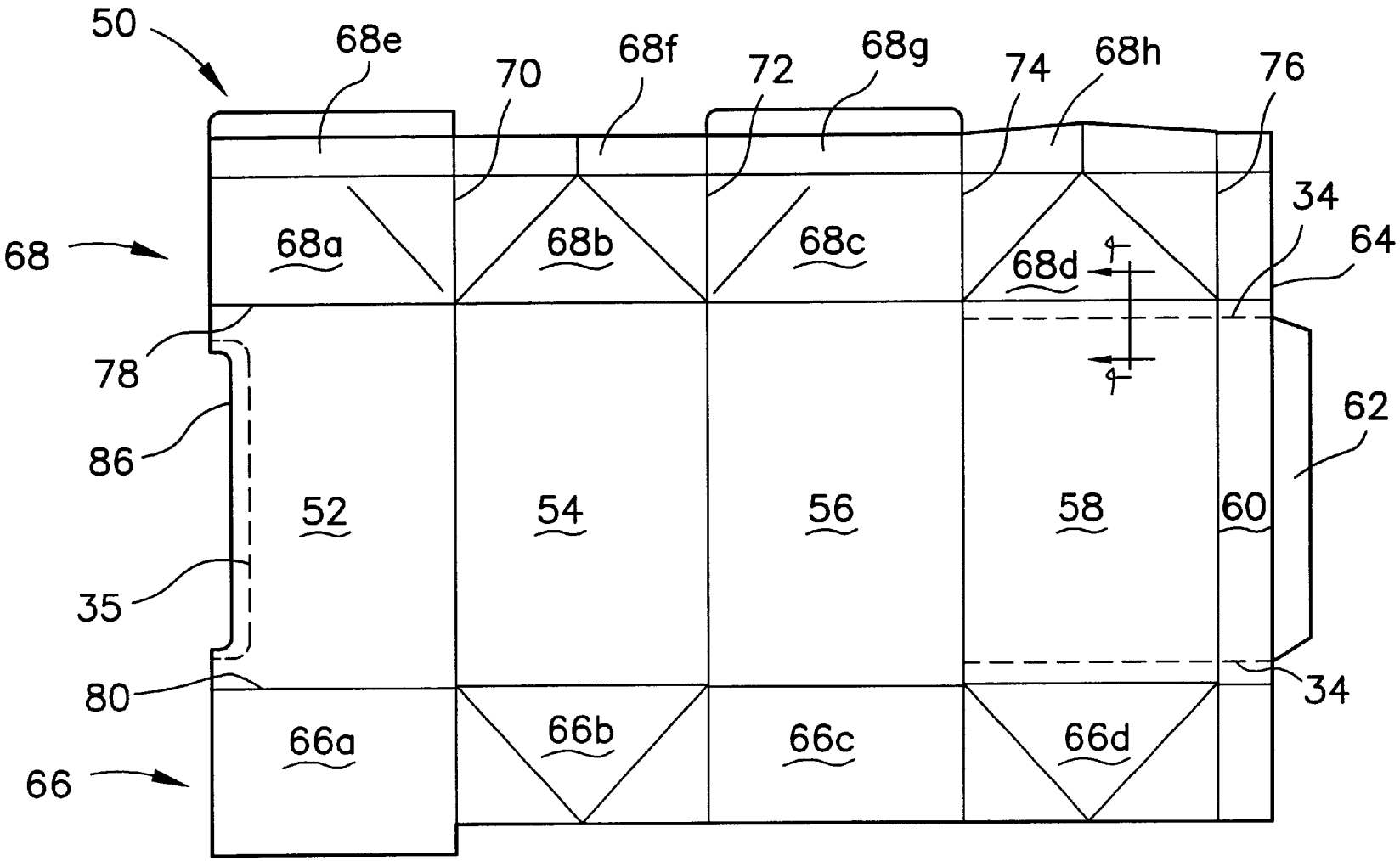
FIG. 3 is a plan view of a blank for forming the package of FIG. 1.

Referring now to FIG. 3, the package 10 is formed from a blank 50 configuration similar to, but slightly modified from, a gable top carton of the same proportions. The blank 50 includes first, second, third, fourth and fifth panels 52, 54, 56, 58 and 60, respectively, which correspond to the front 12, rear 14, bottom 20, top 22 and seal 24 walls. A tab panel 62 can be formed contiguous with and adjacent the fifth panel 60, which tab panel 62 extends from the fifth panel 60 between the cover perforations 34 where the perforations 34 extend to the edge 64 of the fifth panel 62. The tab 62 is shorter than the fifth panel 60. The panels 52–60 are separated from one another by first, second, third and fourth crease or score lines 70, 72, 74, 76, respectively.

The blank 50 includes a pair of respective side panel sets, 66, 68, that correspond to the bottom and top panels of a standard gable top carton. Each set of side panel sets 66, 68 is separated from its respective front, rear, top and bottom panels by a horizontal score or crease line 78, 80. It is to be noted that the term horizontal used with respect to this and the following crease or score line is used in that the orientation of the blank in the enclosed FIG. 3 is shown in that manner. In use, the score lines or crease lines would lie vertically when the blank is laid out in the usable configuration of the carton.

The panels of side panel set 68 are configured having an otherwise gable top configuration. That is, panels 68*a–d* each include top fin panels 68*e–h* extending from an edge thereof The top fin panels 68*e–h* are sealed to one another in forming the conventional carton and the gable G is then folded over onto itself to configure the package 10 in the rectangular block-type configuration illustrated in FIGS. 1–2 and 5–6.

The panels 66*a–d* of side panel set 66 are configured in a like manner to the bottom panels of a conventional gable top carton. Panels 66*a,c* are infolded, which, in turn, urges panels 66*b,d* inwardly. A seal is made across panel 66*a* to form the sealed side wall 16 of the package 10.

In erecting the present package 10, unlike known gable top configurations, the fifth panel 60 is sealed to an outer surface 82 of the first panel 52. That is, it is common for gable top and other type packages to have the fifth panel sealed to an interior surface of the first panel so that it is not visible when the package is erected. In the present package 10 configuration, however, the fifth panel 60 is sealed to the exterior surface 82 of the first panel 52 so that it is fully visible when the package 10 is erected. Upon sealing the fifth panel 60 to the exterior surface 82 of the first panel 52, the tubular form of the blank is made.

The package 10 is erected in accordance with methods and apparatus that will be recognized by those skilled in the art. In a contemplated form, fill and seal process, the package 10 is formed, filled and sealed in a manner similar to standard gable top cartons. That is, panels 66*a–d* of side panel set 66 are folded and sealed to form the side wall 16. As provided above, this side wall 16 corresponds to the bottom wall of a conventional gable top carton. This side wall 16 is also oriented downwardly (as is a bottom wall) during the remainder of the filling and sealing operations of the machine.

After the side wall 16 is formed (i.e., panels 66*a–d* sealed), the package 10 is filled and the other side wall 18 (corresponding to a gable top gable portion) is formed and sealed. Panels 68*a–d* are infolded and top fin panels 68*e–h* are sealed to one another by methods and apparatus that will be recognized by those skilled in the art. After the package 10 is formed having the tradition gable-formed top, the gable G is then folded down onto itself and sealed to one of the gable panels to form the rectangular, brick-like package 10.

As set forth above, the fifth panel 60 can be formed having the tab panel 62 extending therefrom. The tab 62 is set apart from the fifth panel 60 and, unlike the fifth panel 60, is not necessarily (liquid-tight) sealed onto the front wall 12 (e.g., first panel 52). Rather, the tab 62 may be adhered to the front wall 12 by one or more relatively weak, readily broken seals, indicated at 84, formed by, for example, heat sealing or a hot melt adhesive. This maintains the tab panel 62 adjacent the front wall. Essentially, the tab 62 is intended to be adhered to the front wall 12 only so that it remains "flat," lying on the front wall 12, but is readily urged or separated from the wall 12, without being strongly adhered thereto. In this manner, the tab 62 is readily dislodged from (i.e., pulled from) the front wall 12 to facilitate opening the package 10. The tab 62 can be shorter than (i.e., have a lesser length than) the fifth panel 60.

To open the package 10 it is merely necessary to dislodge the tab panel 62 and urge it upwardly so that the front wall 12 "tears" along the perforations 35. Continued urging separates the cover portion 36 from the top wall 22. As set forth above, the perforations 35 can be formed partially into the paperboard core 28 so that separation (at the seal wall 24) occurs within the core 28 rather than at the outer/inner layer sealed juncture or interface 42 of the front wall/seal wall 12/24.

Optionally, as illustrated in FIG. 3, the blank 50 can include a cut-out 86 formed in the first panel 52. The cut-out 86 further facilitates separating the seal wall 24 from the front wall 12 when opening the package 10. The cut-out 86 can also be configured for resealing the package 10, by insertion of the tab 62 behind the front wall 12 at the cut-out 86. Of course, the blank 50 can be formed without the cut-out 86 in the first panel 52.

Figure 7:
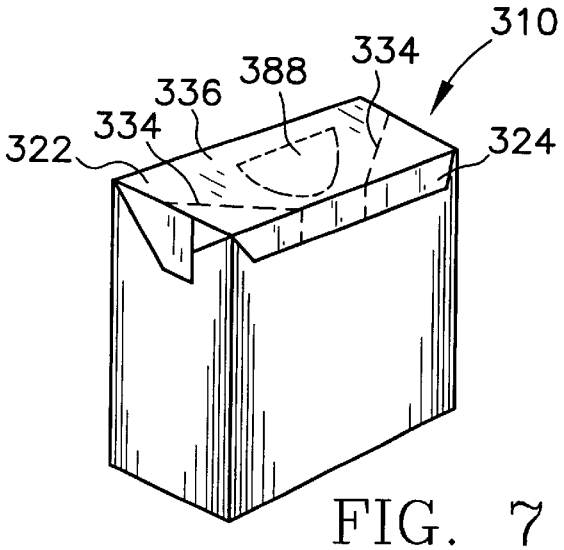
FIG. 7 is still another embodiment of the easy-open package, this embodiment being formed from a parallelepiped type package, such as a TETRA BRIK® brand package.

Another alternate embodiment of the package 310 is illustrated in FIG. 7. In this embodiment, the basic structure of the package 310 as well as the perforations 334 and forming thereof into the material are the same as that shown in the embodiments of FIGS. 1–2 and 5–6. In this embodiment, however, the basic package 310 shape and configuration is that of the well-recognized parallelepiped container such as a TETRA BRIK® brand container.

Figure 10:
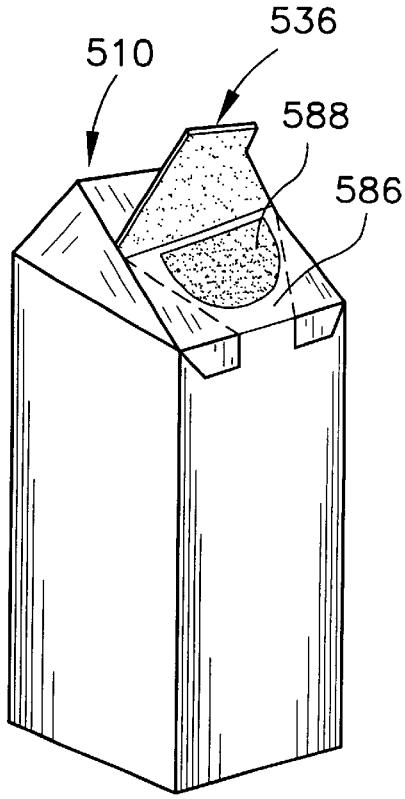
FIG. 10 is a view of the package of FIG. 9 illustrated with the cover portion opened and with an optional dispensing panel positioned on an inside surface of the package.

In such a configuration, the perforations 334 can be formed parallel to one another (not shown), or they can be formed at angles to one another along the top wall 322. In this manner, the cover 336 separates from the top wall 322 along lines that diverge from the seal wall 324 so that the cover portion 336 can be formed to extend essentially the entire width of the package 310. Optionally (as best seen in FIG. 10), a panel can be disposed below the cover 336, which panel has an opening (shown as shadowed at 388 in FIG. 7) formed therein. This opening 388 can be formed having a relatively large area for dispensing larger solid product, such as, for example, corn flakes, bran flakes and the like, or for particulate-containing product, such as soup.

Figure 8:
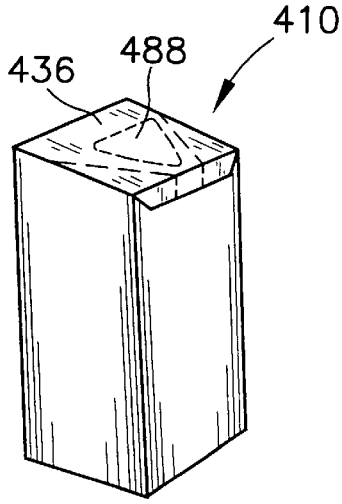
FIG. 8 is still another embodiment of the easy-open package, this embodiment being formed from flat-top type package.

FIG. 8 illustrates yet another embodiment in which a flat top container 410 has a cover 436 arrangement similar to that shown in the embodiment illustrated in FIG. 7. Again, an optional panel can be disposed under the cover panel 436 having an opening 488 therein for dispensing contents.

Figure 9:
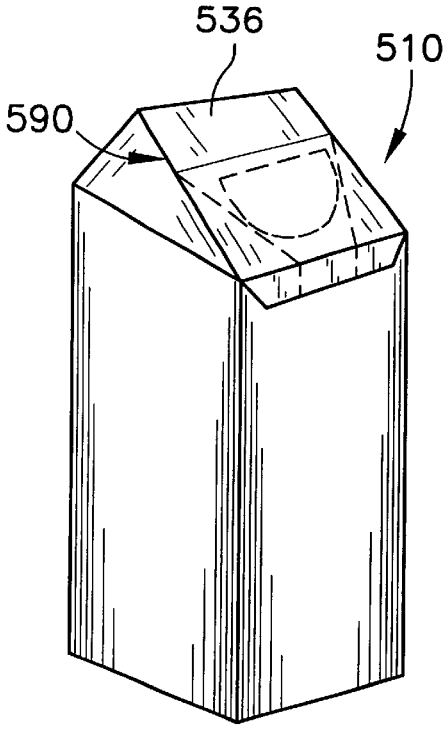
FIG. 9 is yet another embodiment of the easy-open package, this embodiment being formed from a modified gable top carton.

Still another embodiment of the package 510 is shown in FIGS. 9 and 10. In this embodiment, the package 510 is formed from a modified gable top carton. The cover panel 536 is formed on a top or gable panel 590 of the container that would otherwise be configured to have the standard gable arrangement. Again, an optional panel 596 having a dispensing opening 588 can be disposed under the cover 536 to facilitate dispensing contents from the package 510.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A liquid-tight package defining an interior storage space comprising:

a front wall;

a rear wall opposing the front wall;

a pair of opposing side walls;

a bottom wall;

a top wall opposing the bottom wall;

a seal wall contiguous with the top wall and extending from a juncture of the top wall and the seal wall, the seal wall having an edge thereof opposite the juncture, the seal wall being sealed to the front wall at an exterior surface of the front wall;

the opposing side walls being formed from a plurality of side wall panels, the side wall panels being contiguous with and connected to adjacent, respective panels defining the front wall, the rear wall, the bottom wall, the top wall and the seal wall, the side wall panels further being contiguous with and connected to adjacent side wall panels; and at least one line of weakness formed in the top wall, the line of weakness extending from the seal wall at the edge into the top wall and defining a cover portion, the cover portion being formed from a portion of the seal wall and a portion of the top wall, wherein when the top wall and seal wall are separated along the line of weakness, the cover portion is separable from the package, at least in part, to define an open area for accessing the interior storage space of the package, the front wall defining a cut-out portion disposed such that the seal wall overlies the entirety of the cut-out portion when the package is constructed.

2. The liquid-tight package in accordance with claim 1 wherein the package is formed from a laminate material having a paperboard core having a thickness, an inner coating layer and an outer coating layer, and wherein the at least one line of weakness is formed as a line of perforation into the laminate material penetrating the outer coating layer and at least a portion of the thickness of the paperboard core.

3. The liquid-tight package in accordance with claim 2 wherein the line of perforation is formed as a series of discrete cut sections into the laminate material.

4. The liquid-tight package in accordance with claim 2 wherein the line of perforation is formed as a substantially continuous cut section in the laminate material.

5. The liquid-tight package in accordance with claim 1 wherein the at least one line of weakness extends through less than the thickness of the paperboard core.

6. The liquid-tight package in accordance with claim 1 wherein the at least one line of weakness extends through the thickness of the paperboard core.

7. The liquid-tight package in accordance with claim 1 wherein the package includes two lines of weakness, each extending from the seal wall edge to a juncture of the top wall and the rear wall.

8. The liquid-tight package in accordance with claim 7 wherein the lines of weakness are substantially linear and parallel to one another.

9. The liquid-tight package in accordance with claim 7 wherein a juncture of the cover and the rear wall define a hinge region for hingedly opening the cover.

10. The liquid-tight package in accordance with claim 1 including a further line of weakness disposed, at least in part, beneath the seal wall where the seal wall is sealed to the front wall, wherein the line of weakness lies adjacent the cut-out portion.

11. The liquid-tight package in accordance with claim 1 wherein the top wall has a surface area and the cover has a surface area, and wherein the ratio of the cover surface area to the top wall surface area is greater than 0.5.

12. The liquid-tight package in accordance with claim 1 including a tab panel extending from and contiguous with the seal wall, the seal wall having a length that is greater than a length of the tab panel.

13. The liquid-tight package in accordance with claim 1 including a further line of weakness disposed, at least in part, beneath the seal wall where the seal wall is sealed to the front wall.

14. A blank for a liquid-tight package, the blank formed from a laminate material having a paperboard core having a thickness, a coating layer on a first side of the paperboard and a coating layer on a second side of the paperboard core, the blank comprising:

a front wall panel;

a bottom wall panel contiguous with the front wall panel and separated therefrom by a first crease line;

a rear wall panel contiguous with the bottom wall panel and separated therefrom by a second crease line;

a top wall panel contiguous with the rear wall panel and separated therefrom by a third crease line;

a seal wall panel contiguous with the top wall panel and separated therefrom by a fourth crease line;

a pair of side wall panel sets, each of the sets extending from and contiguous with opposing sides of the front, bottom, rear, top and seal walls, each of the pair of side wall panel sets being separated from their respective front, bottom, rear, top and seal walls by fifth and sixth crease lines, respectively, each of the side wall panel sets being formed from a plurality of side wall panels, the side wall panels being contiguous with and connected to adjacent side wall panels within its respective set; and at least one line of weakness formed in the seal wall panel and the top wall panel, extending inwardly from an edge of the seal wall panel, the at least one line of weakness extending across the fourth crease, wherein the front wall defines a cut-out portion disposed such that the seal wall overlies the entirety of the cut-out portion when the package is constructed.

15. The blank in accordance with claim 14 including two lines of weakness, each extending inwardly from the edge of the seal wall panel across the fourth crease.

16. The blank in accordance with claim 15 wherein the two lines of weakness are substantially linear and parallel to one another.

17. The blank in accordance with claim 15 wherein the two lines of weakness extend substantially to the third crease.

18. The blank in accordance with claim 14 wherein the at least one line of weakness is a line of perforation into the laminate material penetrating one of the coating layers and at least a portion of the thickness of the paperboard core.

19. The blank in accordance with claim 14 wherein the at least one line of weakness is a line of perforation into the laminate material penetrating through the thickness of the paperboard core.

20. The blank in accordance with claim 14 including a tab panel extending from and contiguous with the seal wall panel.

21. The blank in accordance with claim 20 wherein the seal wall panel has a length and the tab panel has a length that is less than the length of the seal wall panel.

22. The blank in accordance with claim 14 including a further line of weakness formed in the front wall panel extending inwardly from about an edge thereof, the further line of weakness having a length less than a length of the seal wall panel.

23. The blank in accordance with claim 14 including a further line of weakness disposed, at least in part, between the cut-out portion and the fourth crease line.

* * * * *